US007201596B1

(12) United States Patent
Bukovnik et al.

(10) Patent No.: US 7,201,596 B1
(45) Date of Patent: Apr. 10, 2007

(54) ELECTRICAL CONNECTOR SYSTEMS, PLUG SYSTEMS AND METHODS FOR USING THE SAME

(75) Inventors: Rudolf Robert Bukovnik, Chapel Hill, NC (US); Kenton Archibald Blue, Fuquay-Varina, NC (US); George W. Pullium, III, Garner, NC (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/327,743

(22) Filed: Jan. 6, 2006

(51) Int. Cl.
*H01R 13/52* (2006.01)

(52) U.S. Cl. ..... 439/276; 439/798; 439/936

(58) Field of Classification Search ..... 439/276, 439/798, 475, 936
See application file for complete search history.

(56) References Cited

U.S. PATENT DOCUMENTS

| | | | |
|---|---|---|---|
| 2,311,758 | A | 2/1943 | Johansson |
| 3,020,260 | A | 2/1962 | Nelson |
| 4,369,284 | A | 1/1983 | Chen |
| 4,425,017 | A | 1/1984 | Chan |
| 4,595,635 | A | 6/1986 | Dubrow et al. |
| 4,600,261 | A | 7/1986 | Debbaut |
| 4,634,207 | A | 1/1987 | Debbaut |
| 4,680,233 | A | 7/1987 | Camin et al. |
| 4,701,574 | A | 10/1987 | Shimirak et al. |
| 4,716,183 | A | 12/1987 | Gamarra et al. |
| 4,721,832 | A | 1/1988 | Toy |
| 4,777,063 | A | 10/1988 | Dubrow et al. |
| 4,852,646 | A | 8/1989 | Dittmer et al. |
| 4,880,676 | A | 11/1989 | Puigcerver et al. |
| 4,888,070 | A | 12/1989 | Clark et al. |
| 4,942,270 | A | 7/1990 | Gamarra |
| 4,963,700 | A | 10/1990 | Olsen et al. |
| 5,023,402 | A | 6/1991 | King, Jr. et al. |
| 5,079,300 | A | 1/1992 | Dubrow et al. |
| 5,099,088 | A | 3/1992 | Usami et al. |
| 5,140,476 | A | 8/1992 | Kim |
| 5,177,143 | A | 1/1993 | Chang et al. |
| 5,357,057 | A | 10/1994 | Debbaut |
| 5,364,283 | A * | 11/1994 | Katoh et al. ..... 439/201 |
| 5,529,508 | A | 6/1996 | Chiotis et al. |
| 5,561,269 | A | 10/1996 | Robertson et al. |
| 5,588,856 | A | 12/1996 | Collins et al. |

(Continued)

FOREIGN PATENT DOCUMENTS

DE 34 28 258 A1 2/1986

(Continued)

OTHER PUBLICATIONS

Homac Mfg. Company, Fact Sheet, "*Flood-Seal*"® *Rubberized Aluminum Bar*.

(Continued)

*Primary Examiner*—Michael C. Zarroli
(74) *Attorney, Agent, or Firm*—Myers Bigel Sibley & Sajovec, PA

(57) ABSTRACT

An electrical connector system for use with a conductor includes an electrical connector and a plug assembly. The electrical connector includes a housing defining a conductor passage adapted to receive the conductor therethrough. The plug assembly includes a plug member and a plug sealant mounted on the plug member. The plug assembly is adapted to be inserted into the conductor passage to plug the conductor passage.

38 Claims, 12 Drawing Sheets

U.S. PATENT DOCUMENTS

| | | | | |
|---|---|---|---|---|
| 5,824,954 | A | 10/1998 | Biche et al. | |
| 5,828,005 | A | 10/1998 | Huynh-Ba et al. | |
| 5,848,913 | A | 12/1998 | Ashcraft | |
| 5,962,811 | A | 10/1999 | Rodrigues et al. | |
| 6,025,559 | A | 2/2000 | Simmons | |
| 6,730,847 | B1 | 5/2004 | Fitzgerald et al. | |
| 6,848,949 | B2 * | 2/2005 | Mullaney et al. | 439/676 |
| 6,854,996 | B2 * | 2/2005 | Yaworski et al. | 439/276 |
| 6,997,759 | B1 * | 2/2006 | Zahnen et al. | 439/798 |
| 7,037,128 | B2 * | 5/2006 | Yaworski et al. | 439/276 |
| 2002/0102874 | A1 | 8/2002 | Hobson et al. | |
| 2004/0157488 | A1 | 8/2004 | Yaworski et al. | |

FOREIGN PATENT DOCUMENTS

| | | | |
|---|---|---|---|
| DE | 90 04 669 | U1 | 6/1990 |
| EP | 0 108 518 | B1 | 5/1984 |
| EP | 0 203 737 | A2 | 12/1986 |
| EP | 0 328 386 | A2 | 8/1989 |
| WO | WO 88/00603 | A2 | 1/1988 |
| WO | WO 90/05401 | A1 | 5/1990 |
| WO | WO 95/15600 | A1 | 6/1995 |
| WO | WO 95/24756 | A1 | 9/1995 |
| WO | WO 96/23007 | A1 | 8/1996 |
| WO | WO 97/42693 | A1 | 11/1997 |

OTHER PUBLICATIONS

Connector Mfg. Company, Fact Sheet, *Submersible Secondary Connectors,* Jun. 2001, p. B-1.

* cited by examiner

ELECTRICAL CONNECTOR SYSTEMS, PLUG SYSTEMS AND METHODS FOR USING THE SAME

FIELD OF THE INVENTION

The present invention relates to electrical connectors and methods for using the same and, more particularly, to environmentally protected electrical connectors and methods for forming environmentally protected connections.

BACKGROUND OF THE INVENTION

Multi-tap or busbar connectors are commonly used to distribute electrical power, for example, to multiple residential or commercial structures from a common power supply feed. Busbar connectors typically include a conductor member formed of copper or aluminum housed in a polymeric cover. The conductor member includes a plurality of cable bores. The cover includes a plurality of ports, each adapted to receive a respective cable and to direct the cable into a respective one of the cable bores. A set screw is associated with each cable bore for securing the cables in the respective bores and, thereby, in electrical contact with the conductor member.

The busbar assemblies as described above can be used to electrically connect two or more cables. For example, a feed cable may be secured to the busbar connector through one of the ports and one or more branch or tap circuit cables may be connected to the busbar connector through the other ports to distribute power from the feed cable. Busbar connectors of this type provide significant convenience in that cables can be added and removed from the connection as needed.

Power distribution connections as discussed above are typically housed in an above-ground cabinet or a below-grade box. The several cables are usually fed up through the ground and the connection (including the busbar connector) may remain unattached to the cabinet or box (i.e., floating within the cabinet). The connections may be subjected to moisture, and may even become submerged in water. If the conductor member and the conductors are left exposed, water and environmental contaminants may cause corrosion thereon. Moreover, the conductor member is often formed of aluminum, so that water may cause oxidation of the conductor member. Such oxidation may be significantly accelerated by the relatively high voltages employed (typically 120 volts to 1000 volts). In order to reduce or eliminate exposure of the conductor member and the conductor portions of the cables to water, some known busbar designs include elastomeric boots or caps. These caps or boots may be difficult or inconvenient to install properly, particularly in the field, and may not provide reliable seals.

U.S. Pat. No. 6,854,996 and U.S. Patent Application Publication No. 2004/0157488 A1 disclose sealant-filled (e.g., gel-filled) multi-tap busbars.

SUMMARY OF THE INVENTION

According to embodiments of the present invention, an electrical connector system for use with a conductor includes an electrical connector and a plug assembly. The electrical connector includes a housing defining a conductor passage adapted to receive the conductor therethrough. The plug assembly includes a plug member and a plug sealant mounted on the plug member. The plug assembly is adapted to be inserted into the conductor passage to plug the conductor passage.

According to some embodiments, the plug assembly is adapted to deposit a portion of the plug sealant in the conductor passage when the plug assembly is inserted into the conductor passage and thereafter withdrawn from the conductor passage. According to some embodiments, the plug sealant is a gel. The electrical connector system may include a connector sealant disposed in the conductor passage. According to some embodiments, the plug sealant and the connector sealant are each gels. The electrical connector system may include a securing mechanism to inhibit displacement of the plug assembly from the conductor passage.

According to further embodiments of the present invention, a plug system for use with an electrical connector including a housing defining a conductor passage adapted to receive a conductor therethrough includes a plug assembly. The plug assembly includes a plug member and a plug sealant mounted on the plug member. The plug assembly is adapted to be inserted into the conductor passage to plug the conductor passage.

According to some embodiments, the plug assembly is adapted to deposit a portion of the plug sealant in the conductor passage when the plug assembly is inserted into the conductor passage and thereafter withdrawn from the conductor passage. According to some embodiments, the plug sealant is a gel.

According to further embodiments of the present invention, a method for using a connector system including an electrical connector and a plug assembly, the connector including a housing defining a conductor passage adapted to receive a conductor therethrough, the plug assembly including a plug member and a plug sealant mounted on the plug member, includes inserting the plug assembly into the conductor passage to plug the conductor passage.

The method may further include, after inserting the plug assembly into the conductor passage, withdrawing the plug assembly from the conductor passage such that a portion of the plug sealant remains in the conductor passage. According to embodiments, the plug sealant is a gel.

Further features, advantages and details of the present invention will be appreciated by those of ordinary skill in the art from a reading of the figures and the detailed description of the preferred embodiments that follow, such description being merely illustrative of the present invention.

DETAILED DESCRIPTION OF THE EMBODIMENTS OF THE INVENTION

Figure 1:
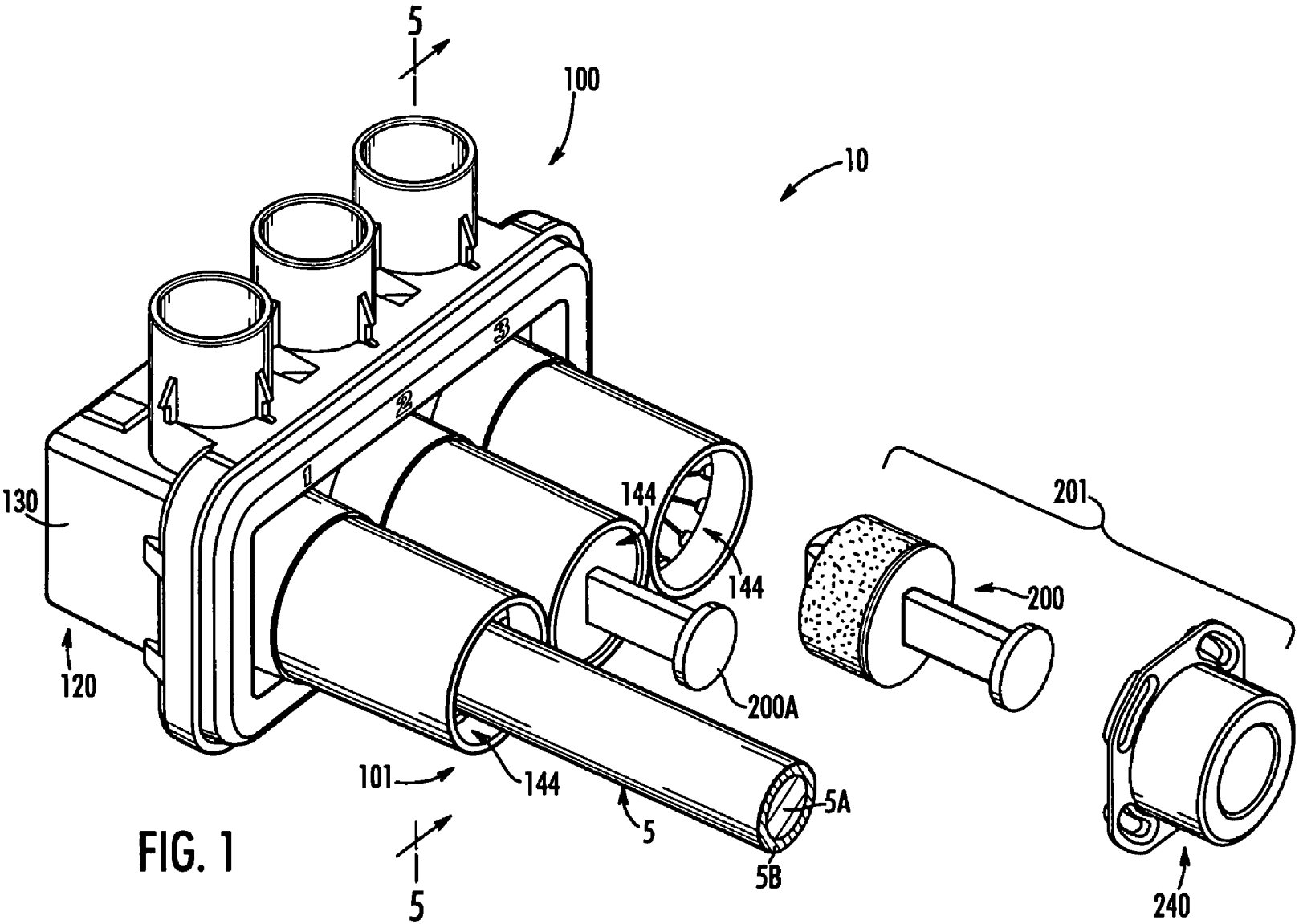
FIG. 1 is a partially exploded perspective view of an electrical connection assembly system including a busbar assembly system according to embodiments of the present invention and a cable.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout. As used herein the term "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

As used herein the expression "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

With reference to FIGS. 1–10, an electrical connector or busbar assembly system 10 according to embodiments of the present invention is shown therein. The busbar assembly system 10 includes an electrical connector or busbar assembly 100 and one or more plug assemblies 200, 200A.

Figure 6:
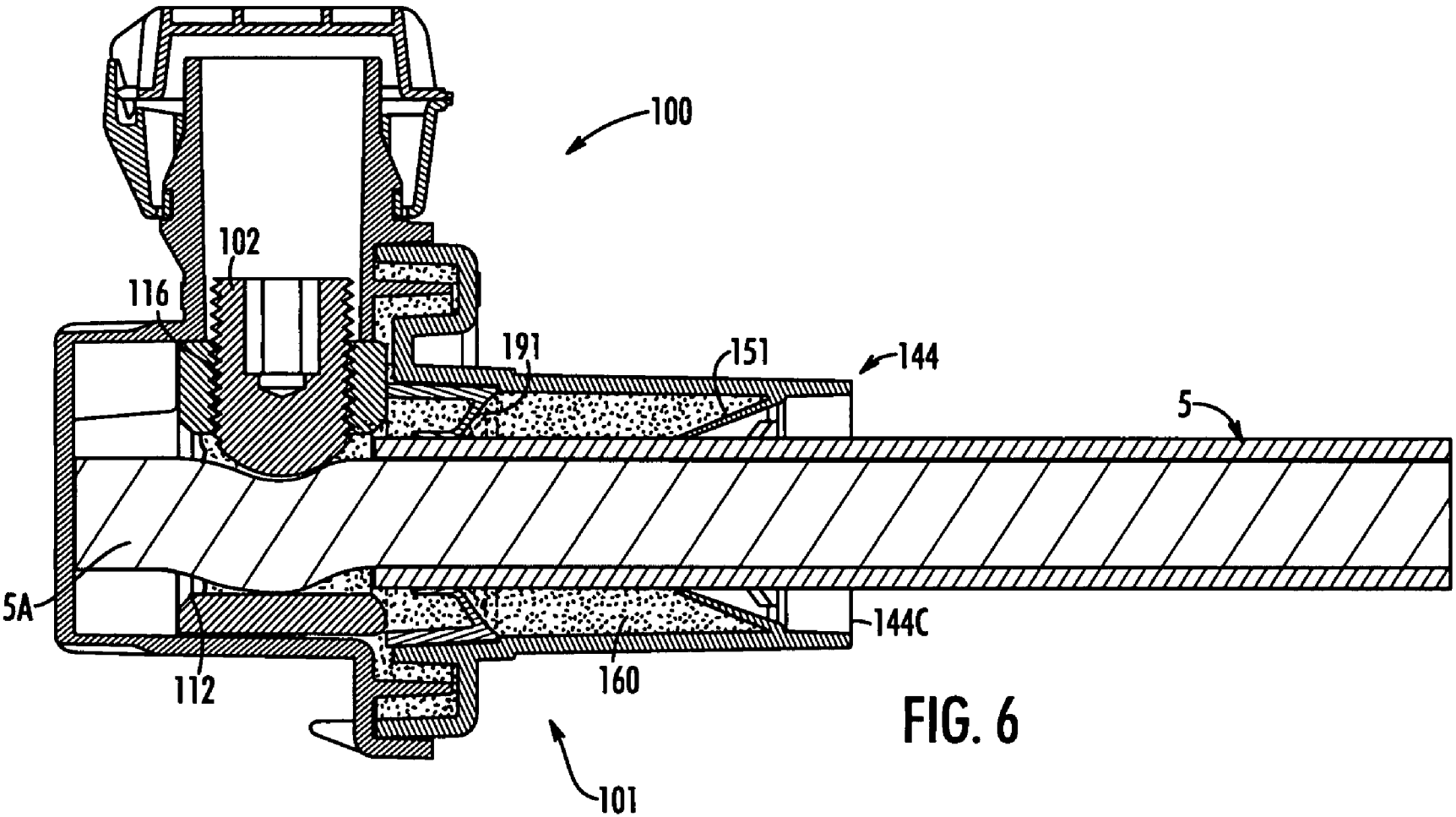
FIG. 6 is a cross-sectional view of the busbar assembly of FIG. 1 taken along the same line as the view of FIG. 5, and wherein a cable is installed in the busbar assembly.

The busbar assembly 100 may be used to electrically connect a plurality of electrical conductors, such as the conductor 5A of an exemplary cable 5 (which further includes an electrically insulative sheath or cover 5B), as shown in FIGS. 1 and 6. The busbar assembly 100 may provide an environmentally protected and, according to some embodiments, watertight, connector and connection. For example, the busbar assembly 100 may be used to electrically connect the conductors of a power feed cable and one or more branch or tap cables, while preventing the conductive portions of the cables and the busbar assembly 100 from being exposed to surrounding moisture or the like.

The plug assemblies 200, 200A may each be used to temporarily close and/or recharge a port of the busbar assembly 100, as discussed hereinafter. In FIG. 1, a first plug assembly 200 (which is mounted in a cover member 240 to form a plug system 201) is shown awaiting installation in an entry port 144 of the busbar assembly 100. Also in FIG. 1, a second plug assembly 200A is shown installed in a further entry port 144 of the busbar assembly 100. The installed plug assembly 200A may serve to charge or recharge the port 144 with a sealant and may be removable to allow insertion of a cable into the port 144. In this manner and as discussed in more detail below, the plug assemblies 200, 200A may be used to reseal and/or recharge a port 144 of the busbar assembly following removal of a cable from the port 144.

Figure 2:
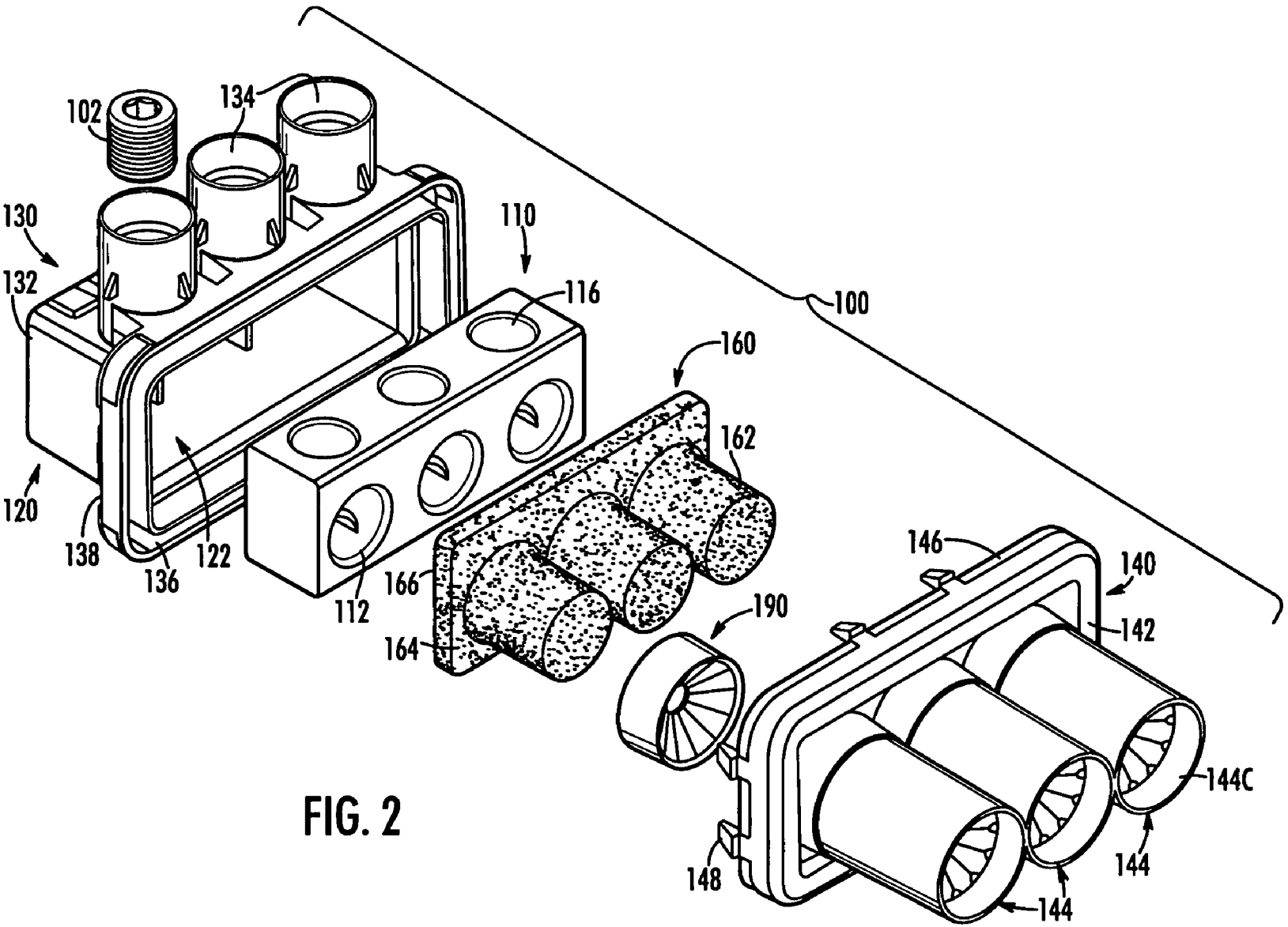
FIG. 2 is an exploded, perspective view of a busbar assembly forming a part of the busbar assembly system of FIG. 1.

Turning to the busbar assembly 100 in more detail, the busbar assembly 100 includes a busbar conductor member 110, a cover assembly 120, a plurality of set screws 102, and a mass of sealant 160 (best seen in FIG. 2). The cover assembly 120 includes a rear cover member 130 and a front cover member 140. The cover assembly 120 defines an interior cavity 122 within which the conductor member 110 is disposed. The interior cavity 122 is environmentally protected.

The conductor member 110 includes three cable or conductor bores 112, each having a front opening 114. The conductor bores 112 are sized and shaped to receive conductors such as the conductor 5A. Three threaded bores 116 extend orthogonally to and intersect respective ones of the conductor bores 112. The conductor member 110 may be formed of any suitable electrically conductive material. In some embodiments, the conductor member 110 is formed of copper or aluminum. In certain preferred embodiments, the conductor member 110 is formed of aluminum. The conductor member 110 may be formed by molding, stamping, extrusion and/or machining, or by any other suitable process(es).

The rear cover member 130 includes a body portion 132. A transversely extending rib 133 (FIG. 5) projects into the interior cavity 122 from the body portion 132. Three access ports 134 are provided on the body portion 132. Each access port 134 communicates the interior cavity 122. A perimeter flange 136 extends about the body portion 132. A plurality of latch slots 138 are formed in the flange 136.

Figure 5:
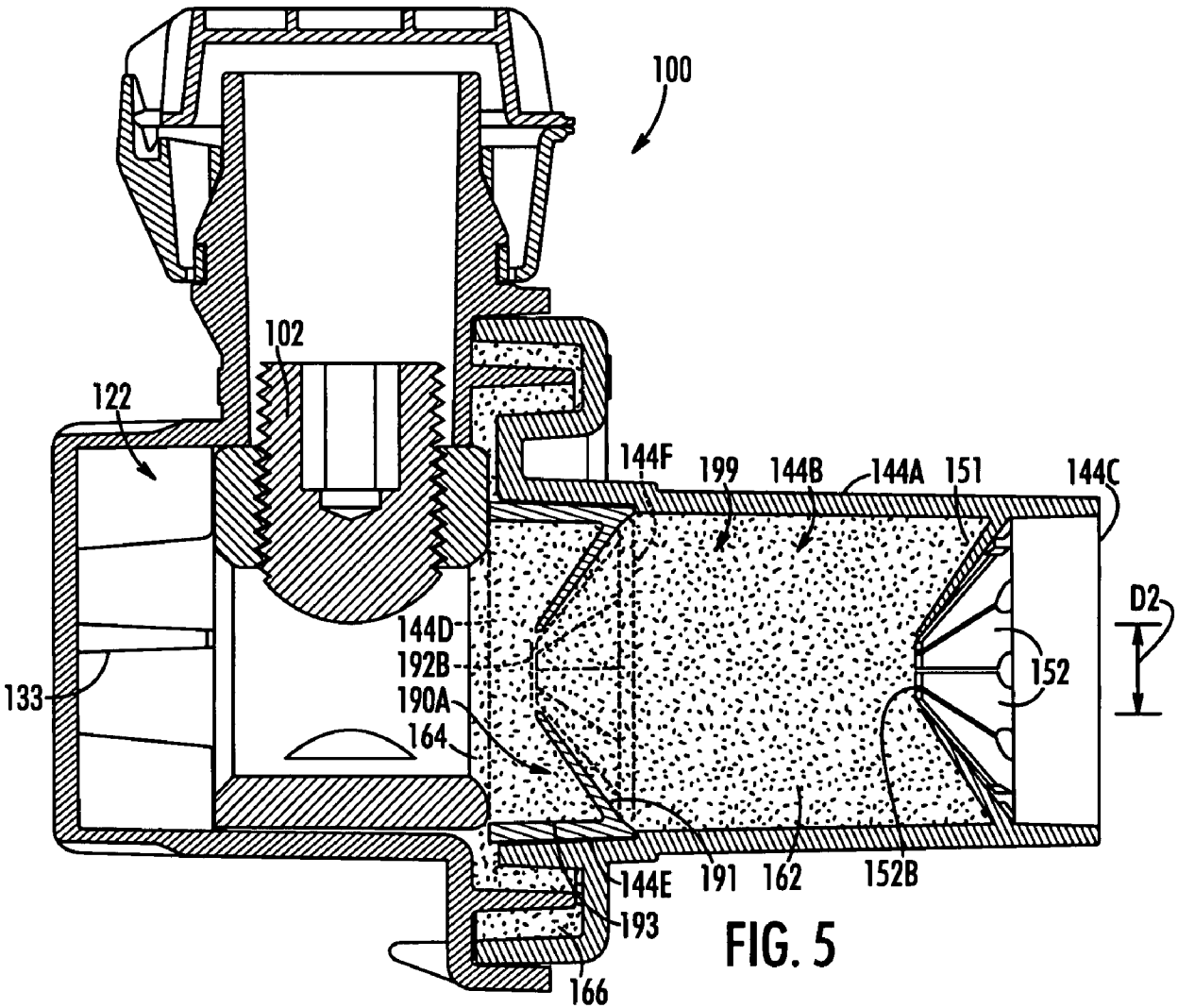
FIG. 5 is a cross-sectional view of the busbar assembly of FIG. 1 taken along the line 5—5 of FIG. 1.

The front cover member 140 includes a body portion 142. Three conductor or cable ports 144 are provided on the body portion 142. As shown in FIG. 5, each port 144 includes a cable tube 144A defining a cable passage 144B. The cable passage 144B communicates with an entrance opening 144C and an exit opening 144D.

A penetrable closure wall 151 extends across the passage 144B between the openings 144C and 144D. The closure wall 151 may be integrally molded with the tube 144A. The closure wall 151 includes a plurality of discrete fingers or flaps 152 which may be separated by gaps. The flaps 152 are flexible. According to some embodiments, the flaps 152 are also resilient.

According to some embodiments, the flaps 152 are concentrically arranged and taper inwardly in an inward direction from the entrance opening 144C to the exit opening 144D to form a generally conical or frusto-conical shape. According to some embodiments, the angle of taper is between about 10 and 60 degrees. The closure wall 151 defines a hole 152B that may be centrally located. According to some embodiments, the inner diameter D2 of the hole 152B is less than the outer diameter of the cable or cables (e.g., the cable 5) with which the busbar assembly 100 is intended to be used. The thickness of the flaps 152 may taper in a radially inward direction. According to some embodiments, the thickness of the flaps 152 tapers in the radially inward direction at a rate of between about zero and 50 percent/inch.

A perimeter flange 146 surrounds and projects rearwardly from the body portion 142. A plurality of barbed latch projections 148 extend rearwardly from the flange 146.

According to some embodiments, the front cover member 140 is integrally formed and the rear cover member 130 is integrally formed. The cover members 130, 140 may be formed of any suitable electrically insulative material. According to some embodiments, the cover members 130, 140 are formed of a molded polymeric material such as polypropylene, polyethylene or a thermoplastic elastomer. According to some embodiments, one or both of the cover members 130, 140 are formed of a translucent material such as polycarbonate, clarified PP, or methyl pentene. The cover members 130, 140 may be formed of a flame retardant material, and may include a suitable additive to make the cover members flame retardant.

The busbar assembly 100 further includes three insert members 190, each of which is positioned in the passage 144B of a respective one of the ports 144. Referring to FIGS. 2 and 5, each insert member 190 is positioned in the passage 144B adjacent the exit opening 144D. The insert member 190 is seated in a recess 144E in the tube 144A and positively captured between a ledge 144F and the front face of the conductor member 110. Additionally or alternatively, the insert member 190 may be otherwise secured within the passage 144B, for example, by welding, adhesive, friction fit, a mechanical latch or latches, one or more fasteners or the like.

Each insert member 190 includes a tubular body defining a passage 190A. The insert member 190 further includes a penetrable closure wall 191 extending across the passage 190A. The closure wall 191 may be integrally formed with the body 193. The closure wall 191 may be constructed in the same manner as discussed above with regard to the closure wall 151, and includes a plurality of flaps 192 separated by gaps 192A and defining a hole 192B.

As best seen in FIGS. 2 and 5, the sealant 160 is disposed in the cover assembly 120. A body sealant portion 164 of the sealant 160 is disposed in a front portion of the interior cavity 122. The sealant portion 164 includes a perimeter portion 166 that is disposed in the flange 136 to form a surrounding seal between the cover members 130, 140. According to some embodiments, the sealant 160 is a gel.

A plurality of port sealant portions 162 are disposed in respective ones of the ports 144. In some embodiments and as illustrated, each port sealant portion 162 extends from the inner side of the closure wall 151 to the exit opening 144D of the associated port 144 and is contiguous with the body sealant portion 164. The closure walls 151 and 191 of each port 144 define a sealing chamber or region 199 therebetween (FIG. 5). The corresponding portion 162 of the sealant 160 is disposed in the sealing region 199. According to some embodiments, the sealant 162 substantially fills the sealing region 199. The sealant portion 164 includes portions disposed between the closure wall 191 and the conductor member 110 of each port 144.

Each of three set screws 102 is threadedly installed in a respective one of the threaded bores 116. Each of the screws 102 includes a socket that may be adapted to receive a driver, for example. Plugs or caps may be provided to selectively cover the access ports 134.

The plug assemblies 200, 200A may be constructed in the same manner as one another and only the plug assembly 200 will be described in detail, it being understood that the description of the plug assembly 200 likewise applies to the plug assembly 200A.

Figure 3:
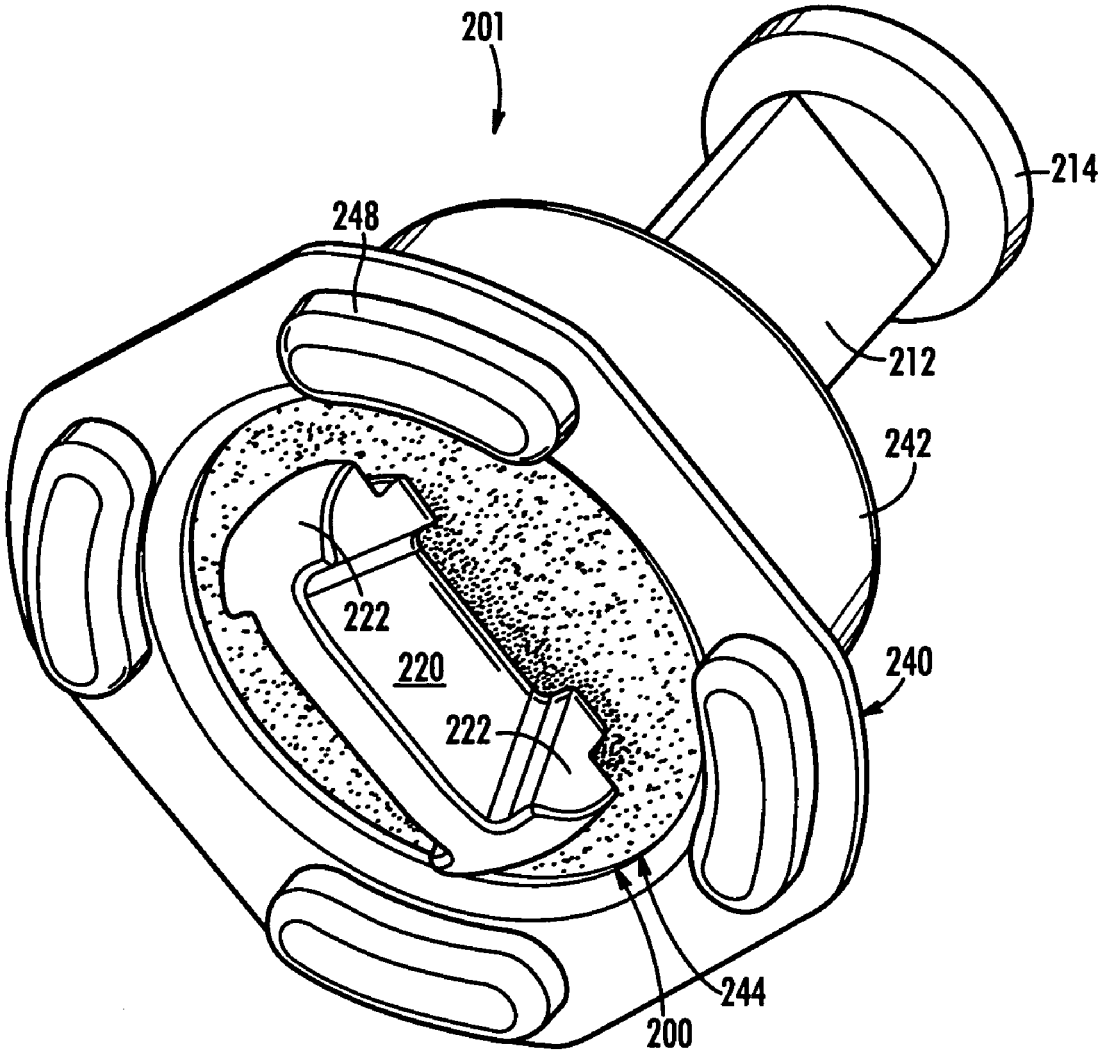
FIG. 3 is an enlarged, rear perspective view of a plug assembly system forming a part of the busbar assembly system of FIG. 1.
Figure 4:
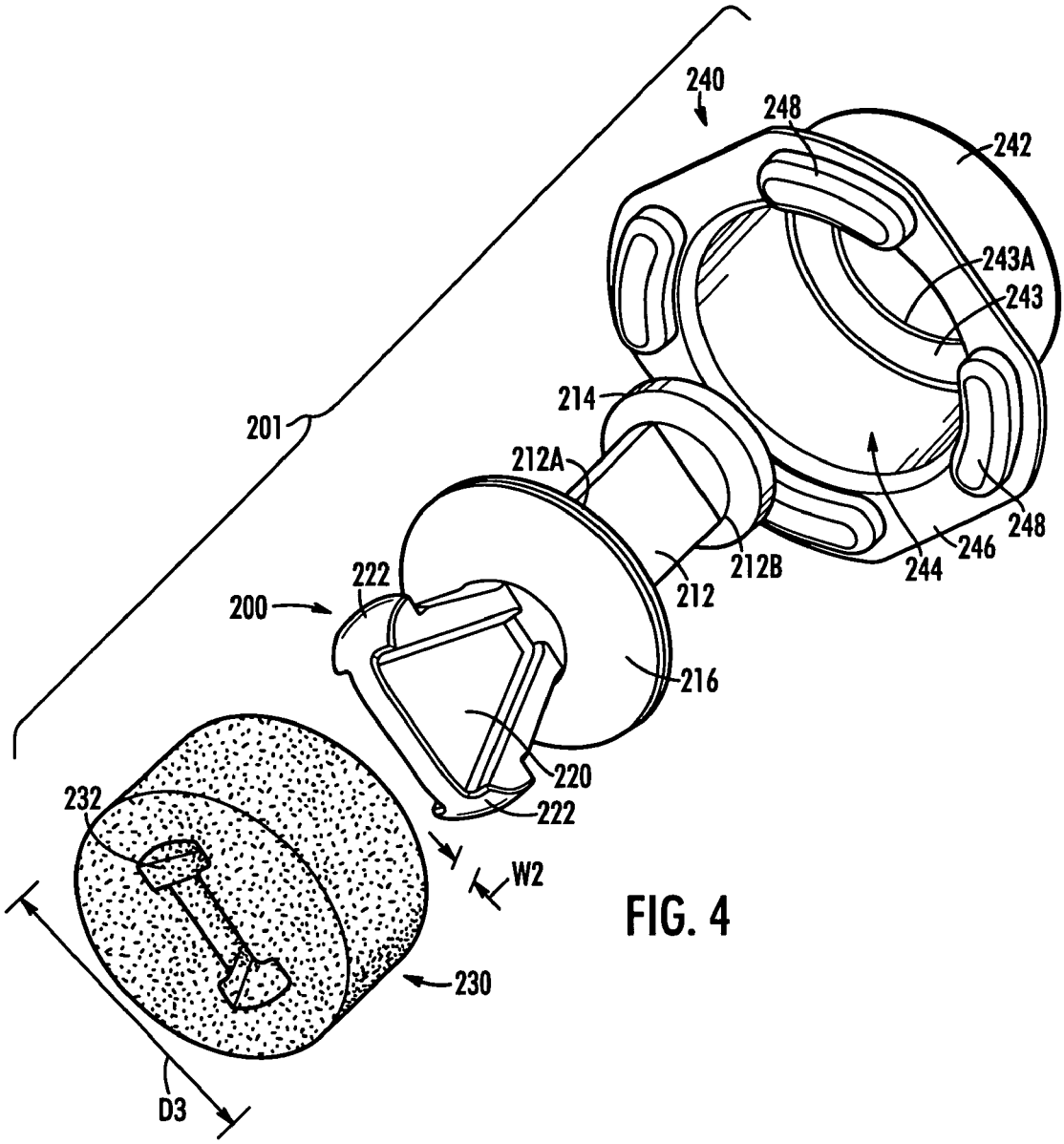
FIG. 4 is an enlarged, exploded, perspective view of the plug assembly system of FIG. 3.

As discussed above, the plug assembly 200 may be provided as part of the plug system 201, which further includes the cover member 240. According to some embodiments, the cover member 240 may be omitted. The plug system 201 may be supplied as a preassembled unit as shown in FIG. 3. Alternatively, the plug assembly 200 may be provided as a preassembled unit without the cover member 240. Alternatively, the plug assembly 200 or the plug system 201 may be provided as a kit that may be assembled in the field, for example. The plug assembly 200 includes a plug member 210 and a mass of sealant 230.

Figure 8:
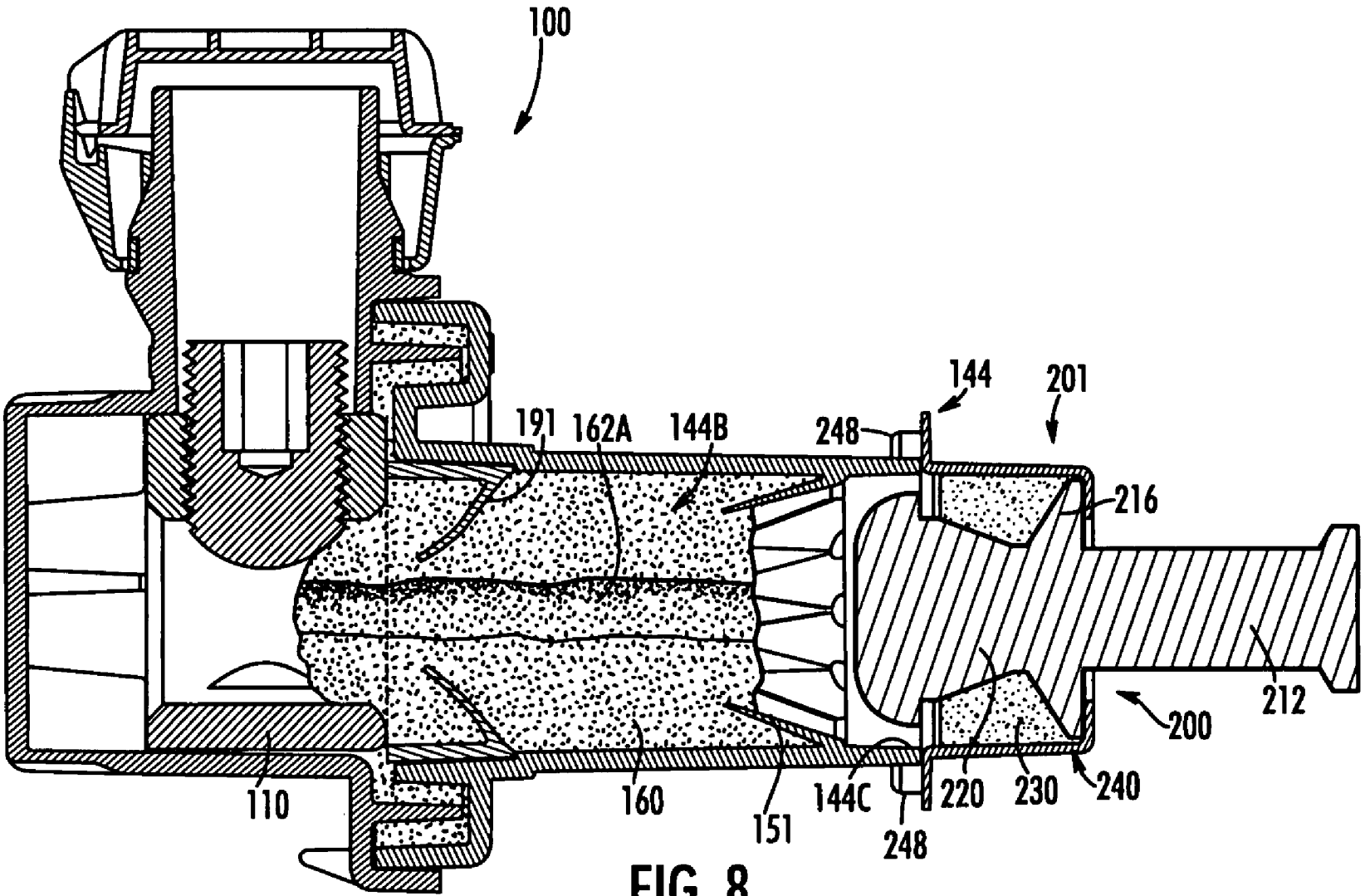
FIG. 8 is a cross-sectional view of the busbar assembly of FIG. 1 taken along the same line as the view of FIG. 5, and wherein the plug assembly system is positioned adjacent the busbar assembly in preparation for installation of a plug assembly.

The plug member 210 includes a body or handle 212 having a rear end 212A and a front end 212B. A flange 214 extends radially outwardly from the front end 212B. A head 220 is located on the rear end 212A of the handle 212. A pair of opposed latch structures or tabs 222 extend radially outward from the head 220. According to some embodiments, each tab 222 has a radially extending width W1 of between about 0.5 and 5.0 mm. An intermediate flange 216 extends radially outwardly from the rear end 212A of the handle 212 between the handle 212 and the head 220. The rear face of the flange 216 may be frusto-conically shaped as best seen in FIG. 8.

The plug member 210 is integrally constructed. According to some embodiments, the plug member 210 is unitarily molded. The plug member 210 may be formed of any suitable material. According to some embodiments, plug member 210 is formed of an electrically insulative material. According to some embodiments, the plug member 210 is formed of a molded polymeric material, and according to some embodiments, the plug member 210 is formed of polypropylene, polyethylene and/or a thermoplastic elastomer. The plug member 210 may be formed of a flame retardant material, and may include a suitable additive to make the plug member 210 flame retardant.

The sealant 230 is mounted on the head 220, which extends through an axial passage 232 defined in the sealant 230. The sealant 230 may be releasably adhered to the head 220 and/or the flange 216. The sealant 230 may have a generally cylindrical or frusto-conical outer surface as illustrated. According to some embodiments, the outer diameter D3 of the sealant 230 is less than the inner diameter of the port passage 144B. According to some embodiments, the outer diameter D3 is between about 0.1 and 2.0 mm less than the inner diameter of the port passage 144B. According to some embodiments, the outer diameter D3 is substantially the same as the outer diameter of the flange 216.

The sealant 230 may be any suitable sealant. According to some embodiments, the sealant 230 and the sealant 160 are formed of the same sealant material. According to some embodiments, the sealant 230 is a gel. According to some embodiments, the sealant 160 and the sealant 230 are both gels, and according to some embodiments, are formed of the same gel material.

The cover member 240 includes a generally cylindrical or frusto-conical side wall 242 and a bottom wall 243 that together define a cavity 244 and a rear opening 245. A front opening 243A is defined in the bottom wall 243. A flange 245 surrounds and extends radially outwardly from the opening 245. Spaced apart projections 248 extend rearwardly from the flange 246. According to some embodiments, the inner diameter of the front opening 243A is greater than the outer diameter of the flange 214 and less than the outer diameter of the intermediate flange 216. Prior to installation of the plug assembly 200 in the busbar assembly 100, the cover member 240 is mounted on the plug member 210 and the sealant 230 such that the sealant 230 and a portion of the plug member 210 are disposed in the cavity 244, the handle 212 extends forwardly through the front opening 243A, and the front face of the intermediate flange 216 abuts the bottom wall 243.

The cover member 240 may be formed of any suitable material. According to some embodiments, the cover member 240 is unitarily molded of a polymeric material. Suitable materials for the cover member 240 may include polypropylene, polycarbonate, polyester, polyethylene, polystyrene, and nylon. According to some embodiments, the cover member 240 is vacuum formed.

The busbar assembly 100 may be formed in the following manner. If the sealant 160 requires curing, such as a curable gel, the sealant may be cured in situ. The front cover member 140 is oriented vertically with the body portion 142 over the ports 144 and the inert members 190 mounted in the respective ports 144. Liquid, uncured sealant is dispensed into the front cover member 140, such that it fills the cable passages 144B above the closure walls 150 and also fills a portion of the body member 142. The sealant is then cured in situ. The cover members 130, 140 are then joined and interlocked by means of the latch slots 138 and the latch projections 148 about the conductor member 110. The set screws 102 are installed in the threaded bores 116 through the access ports 134.

The plug system 201 may be formed in the following manner. If the sealant 230 requires curing, such as a curable gel, the sealant may be cured in situ. The plug member 210 is positioned in the cavity 244 of the cover member 240. Liquid, uncured sealant is dispensed into the cover member 240, such that it fully or partly fills the cavity 244. The sealant is then cured in situ.

Referring to FIGS. 5–10, the busbar assembly system 10 may be used in the following manner.

The busbar assembly 100 may be used to form an electrical connection assembly 101 as shown in FIG. 6. The connection assembly 101 includes the busbar assembly 100 and the cable 5, and may include additional cables secured to the busbar assembly 100 in the manner described immediately hereinafter.

With the set screw 102 in a raised position, the cable 5 is inserted into the selected port 144 such that the terminal end of the cable 5 (which has an exposed portion of the conductor 5A) is inserted through the entrance opening 144C, the passage 144A, and the exit opening 144D, and into the conductor bore 112. The cable 5 penetrates and/or displaces the closure wall 151, the sealant 160 (including the sealant portion 162), and the closure wall 191 as shown in FIG. 6. The cable 5 may elastically deflect the flaps of the closure walls 151, 191. As shown, the busbar assembly 100 may be configured such that the interior cavity 122 includes a volume of a compressible gas (e.g., air) to allow insertion of the cable 5 without a proportionate displacement of the sealant 160 out of the interior cavity 122.

The set screw 102 is then rotatively driven (for example, using a driver) into the threaded bore 116 to force the exposed portion of the conductor 5A against the opposing wall of the bore 112. In this manner, the cable 5 is mechanically secured to or captured within the busbar assembly 100 and electrically connected to the conductor member 110. One or more additional cables may be inserted through the other ports 144 and secured using the other set screws 102. In this manner, such other cables are thereby electrically connected to the cable 5 and to one another through the conductor member 110.

The busbar assembly 100 may provide a reliable (and, in at least some embodiments, moisture-tight) seal between the busbar assembly 100 and the cable 5, as well as any additional cables secured in the ports 144. The sealant 160, particularly gel sealant, may accommodate cables of different sizes within a prescribed range. The ports 144 which do not have cables installed therein are likewise sealed by the sealant 160.

Figure 7:
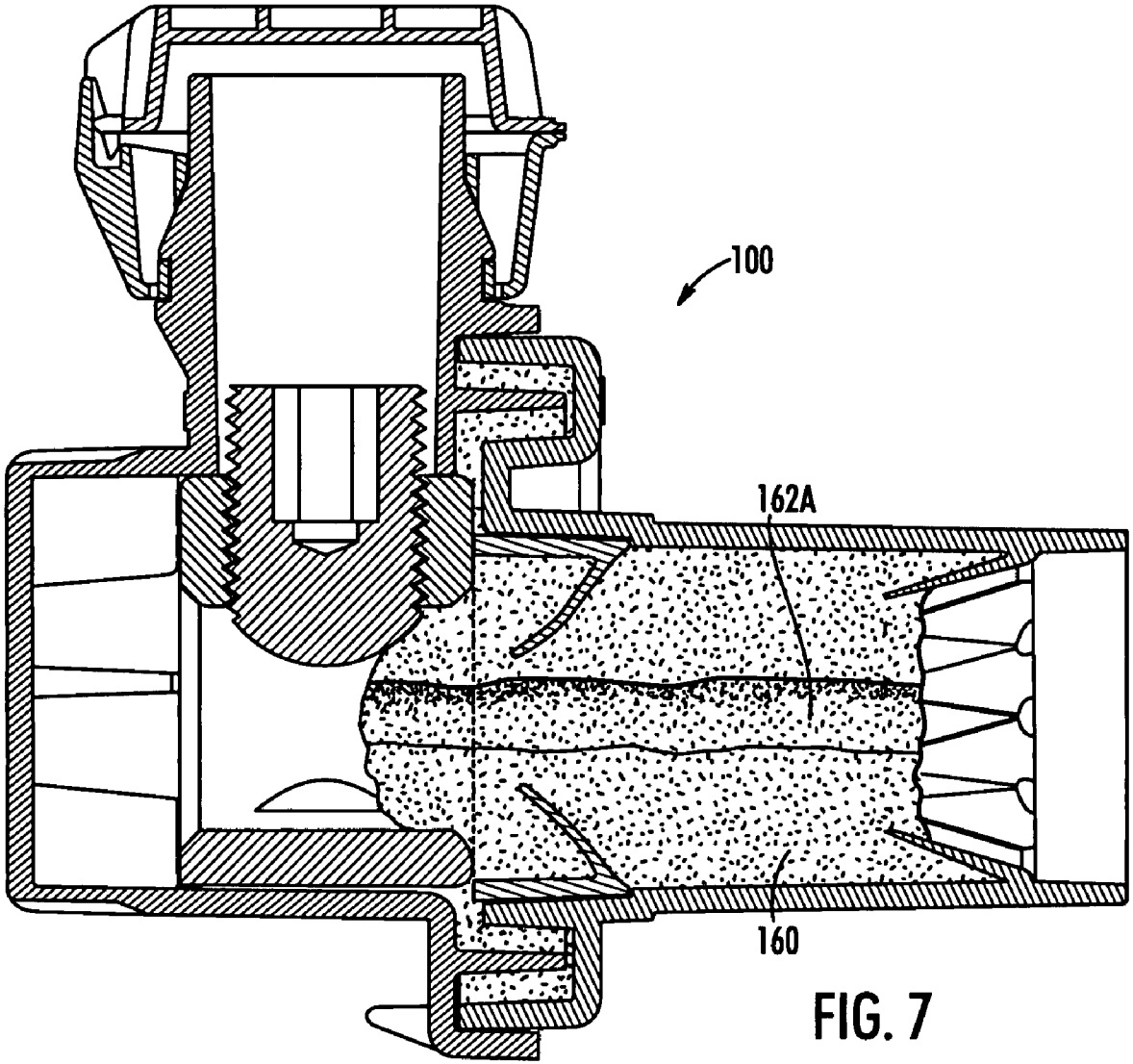
FIG. 7 is a cross-sectional view of the busbar assembly of FIG. 1 taken along the same line as the view of FIG. 5, and wherein the cable has been removed from the busbar assembly.

However, when the cable 5 is subsequently removed as illustrated in FIG. 7, the sealant 160 may not fully return to its initial position. In particular, the sealant 160 may not recover sufficiently to seal the port 144 and/or to form a sufficient seal with a subsequently inserted cable (which may be the same cable). This may occur because the sealant 160 is sheared or otherwise permanently deformed or displaced, or because a portion of the sealant 160 is removed from the busbar assembly 100 (e.g., attached to the cable 5). By way of illustration, in FIG. 7 the sealant 160 is shown defining a residual passage 162A through which moisture may pass and/or which may prevent a subsequent cable from sufficiently displacing the sealant 160 to form an adequate seal.

Figure 9:
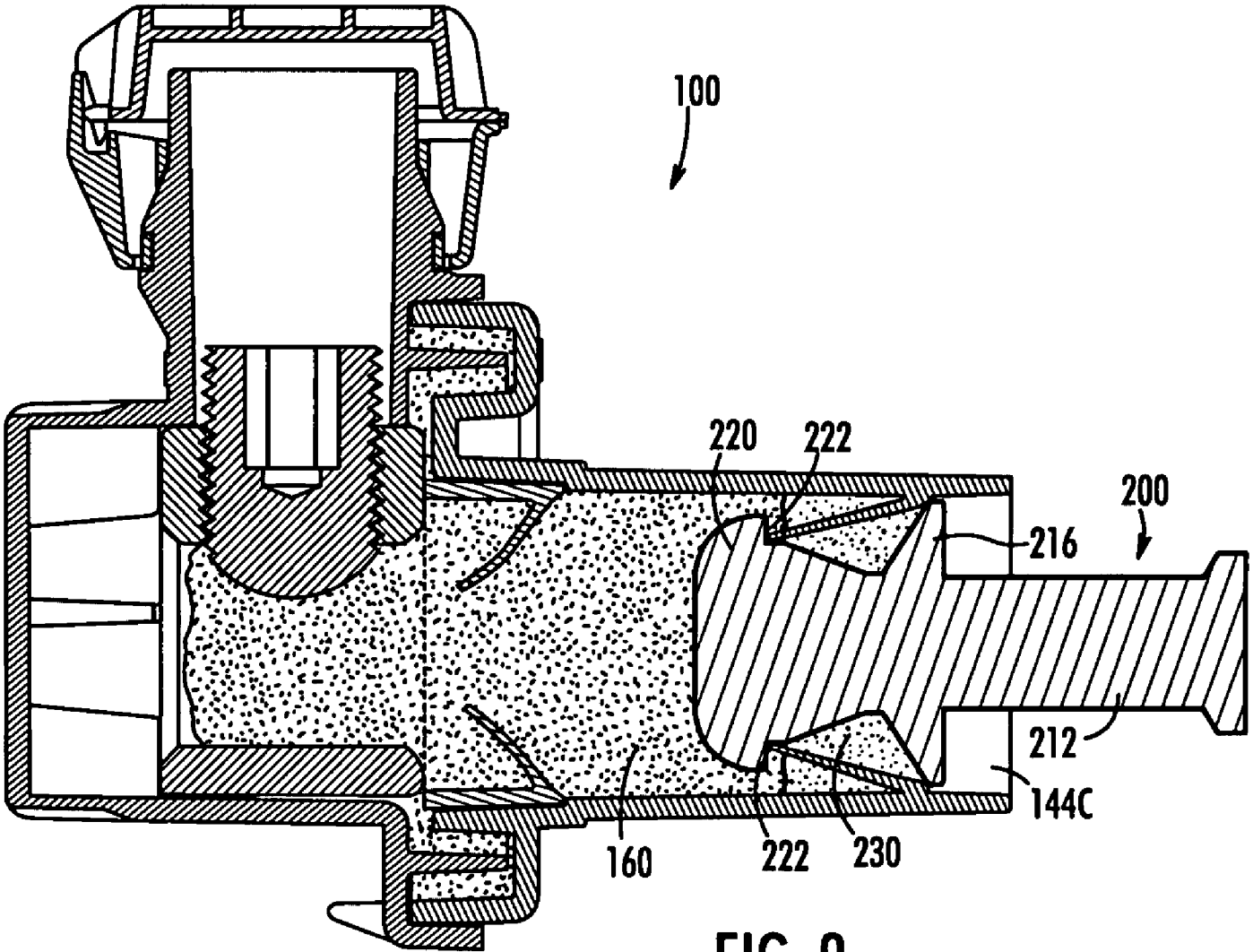
FIG. 9 is a cross-sectional view of the busbar assembly of FIG. 1 taken along the same line as the view of FIG. 5, and wherein the plug assembly has been installed in the busbar assembly.

In accordance with the present invention, the plug system 201 and the plug assembly 200 may be employed to sealingly plug the port 144 and/or recharge the port 144 with sealant. Referring to FIG. 8, the plug system 201 is placed on the front rim of the cable port 144. The projections 248 surround the end of the tube 144A to seat the plug system 201. With the cover member 240 braced as shown, the user pushes the handle 212 toward the port 144 to force the plug assembly 200 into the port 144. In this manner, sealant 230 and the head 220 are pushed out of the cavity 244 and into the cable passage 144B as shown in FIG. 9. The head 220 is passed through the wall 151 such that the tabs 222 interlock with an inner region of the wall 151 to resist removal of the plug member 210 from the port 144. The intermediate flange 216 limits insertion of the plug member 210 into the port by engaging the wall 151 (the outer portion of which serves as a ledge).

With the plug assembly 200 installed in the port 144 as shown in FIG. 9, the sealant 230 supplements the sealant 160 already present in the port 144 and elsewhere in the busbar assembly 100 (i.e., recharges the port 144 with sealant). The sealant 230 may displace existing sealant 160 (e.g., sealant portions 162, 164) to fill voids in the port 144 and/or may itself fill any sealant voids in the port 144. The intermediate flange 216 may serve as a pusher wall to apply a load or pressure to the sealant 230, 160 and prevent or inhibit the sealant from escaping through the front opening 144C of the port 144. When installed, the plug assembly 200 may elastically elongate the sealant 160 and/or the sealant 230 (each of which may be a gel) to provide an improved seal. The intermediate wall 216 may also serve as a barrier to keep dirt, etc. from entering the port 144. The sealant 230 may amalgamate or bond with the sealant 160 to seal therewith.

The user may allow the plug assembly 200 to remain installed in the port 144 as described and shown. The plug assembly 200 will serve as an environmental plug and seal. The plug assembly 200 can be used in this manner as a cap for the port 144.

Figure 10:
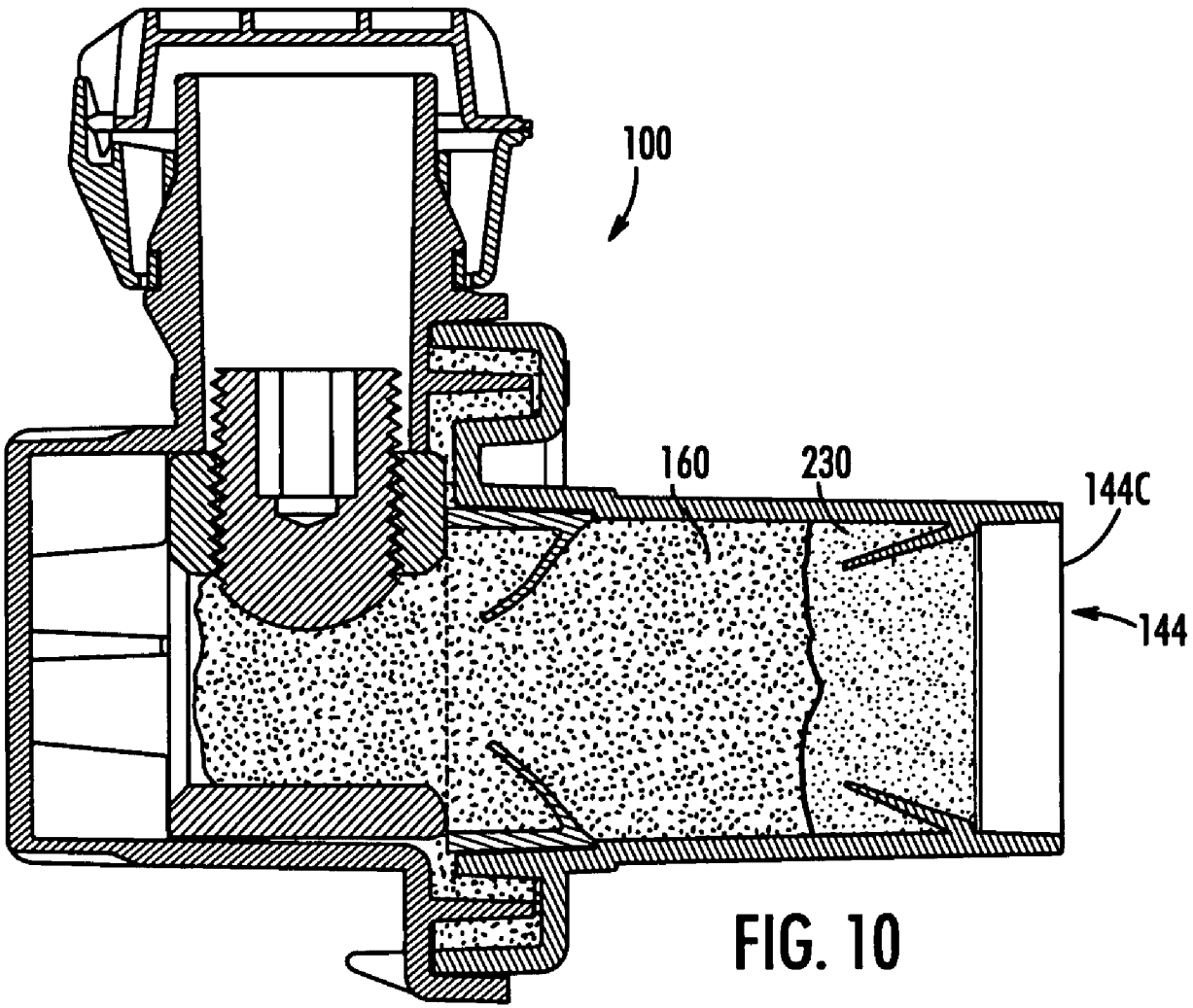
FIG. 10 is a cross-sectional view of the busbar assembly of FIG. 1 taken along the same line as the view of FIG. 5, and wherein the plug assembly has been removed from the busbar assembly.

If and when desired, the user may remove the plug member 210 from the port 144 by pulling the handle 212 out from the front of the port 144, as shown in FIG. 10. The resilient wall flaps 152 will deflect to release the tabs 222, allowing removal of the plug member 210. However, the engagement of the sealant 230 with the sealant 160, the inner surface of the port 144, and/or the wall 151 will prevent some or all of the sealant 230 from being removed from the port 144 with the plug member 210. The sealant 230 retained in the port 144 may serve to provide an improved and/or complete (e.g., watertight) seal with or without a cable installed. Thus, according to some embodiments, the port 144 may remain unused (i.e., no cable installed), but environmentally sealed. According to some embodiments, when desired, a further cable may thereafter be inserted and secured in the recharged port 144 in the same manner as described above.

According to some embodiments, when the plug assembly 200 is removed from the port 144, at least 10% of the plug sealant 230 remains in the port 144 and, according to some embodiments, between about 30 and 90%. However, according to some embodiments a lesser amount or substantially none of the sealant 230 may remain in the port 144.

As discussed above, according to some embodiments, the sealant 160 and/or the sealant 230 are gels. As used herein, "gel" refers to the category of materials which are solids extended by a fluid extender. The gel may be a substantially dilute system that exhibits no steady state flow. As discussed in Ferry, "Viscoelastic Properties of Polymers," 3$^{rd}$ ed. P. 529 (J. Wiley & Sons, New York 1980), a polymer gel may be a cross-linked solution whether linked by chemical bonds or crystallites or some other kind of junction. The absence of the steady state flow may be considered to be the definition of the solid-like properties while the substantial dilution may be necessary to give the relatively low modulus of gels. The solid nature may be achieved by a continuous network structure formed in the material generally through crosslinking the polymer chains through some kind of junction or the creation of domains of associated substituents of various branch chains of the polymer. The crosslinking can be either physical or chemical as long as the crosslink sites may be sustained at the use conditions of the gel.

Gels for use in this invention may be silicone (organopolysiloxane) gels, such as the fluid-extended systems taught in U.S. Pat. No. 4,634,207 to Debbaut (hereinafter "Debbaut '207"); U.S. Pat. No. 4,680,233 to Camin et al.; U.S. Pat. No. 4,777,063 to Dubrow et al.; and U.S. Pat. No. 5,079,300 to Dubrow et al. (hereinafter "Dubrow '300"), the disclosures of each of which are hereby incorporated herein by reference. These fluid-extended silicone gels may be created with nonreactive fluid extenders as in the previously recited patents or with an excess of a reactive liquid, e.g., a vinyl-rich silicone fluid, such that it acts like an extender, as exemplified by the Sylgard® 527 product commercially available from Dow-Corning of Midland, Mich. or as disclosed in U.S. Pat. No. 3,020,260 to Nelson. Because curing is generally involved in the preparation of these gels, they are sometimes referred to as thermosetting gels. The gel may be a silicone gel produced from a mixture of divinyl terminated polydimethylsiloxane, tetrakis (dimethylsiloxy)silane, a platinum divinyltetramethyldisiloxane complex, commercially available from United Chemical Technologies, Inc. of Bristol, Pa., polydimethylsiloxane, and 1,3,5,7-tetravinyltetra-methylcyclotetrasiloxane (reaction inhibitor for providing adequate pot life).

Other types of gels may be used, for example, polyurethane gels as taught in the aforementioned Debbaut '261 and U.S. Pat. No. 5,140,476 to Debbaut (hereinafter "Debbaut '476") and gels based on styrene-ethylene butylenestyrene (SEBS) or styrene-ethylene propylene-styrene (SEPSS) extended with an extender oil of naphthenic or nonaromatic or low aramatic content hydrocarbon oil, as described in U.S. Pat. No. 4,369,284 to Chen; U.S. Pat. No. 4,716,183 to Gamarra et al.; and U.S. Pat. No. 4,942,270 to Gamarra. The SEBS and SEPS gels comprise glassy styrenic microphases interconnected by a fluid-extended elastomeric phase. The microphase-separated styrenic domains serve as the junction points in the systems. The SEBS and SEPS gels are examples of thermoplastic systems.

Another class of gels which may be used are EPDM rubber-based gels, as described in U.S. Pat. No. 5,177,143 to Chang et al.

Yet another class of gels which may be used are based on anhydride-containing polymers, as disclosed in WO 96/23007. These gels reportedly have good thermal resistance.

The gel may include a variety of additives, including stabilizers and antioxidants such as hindered phenols (e.g., Irganox™ 11076, commercially available from Ciba-Geigy Corp. of Tarrytown, N.Y.), phosphites (e.g., Irgafos™ 168, commercially available from Ciba-Geigy Corp. of Tarrytown, N.Y.), metal deactivators (e.g., Irganox™ D1024 from Ciba-Geigy Corp. of Tarrytown, N.Y.), and sulfides (e.g., Cyanox LTDP, commercially available from American Cyanamid Co. of Wayne, N.J.), light stabilizers (e.g., Cyasorb UV-531, commercially available from American Cyanamid Co. of Wayne, N.J.), and flame retardants such as halogenated paraffins (e.g., Bromoklor 50, commercially available from Ferro Corp. of Hammond, Ind.) and/or phosphorous containing organic compounds (e.g., Fyrol PCF and Phosflex 390, both commercially available from Akzo Nobel Chemicals Inc. of Dobbs Ferry, N.Y.) and acid scavengers (e.g., DHT-4A, commercially available from Kyowa Chemical Industry Co. Ltd through Mitsui & Co. of Cleveland, Ohio, and hydrotalcite). Other suitable additives include colorants, biocides, tackifiers and the like described in "Additives for Plastics, Edition 1" published by D.A.T.A., Inc. and The International Plastics Selector, Inc., San Diego, Calif.

The hardness, stress relaxation, and tack may be measured using a Texture Technologies Texture Analyzer TA-XT2 commercially available from Texture Technologies Corp. of Scarsdale, N.Y., or like machines, having a five kilogram load cell to measure force, a 5 gram trigger, and ¼ inch (6.35 mm) stainless steel ball probe as described in Dubrow '300, the disclosure of which is incorporated herein by reference in its entirety. For example, for measuring the hardness of a gel a 60 mL glass vial with about 20 grams of gel, or alternately a stack of nine 2 inch×2 inch×⅛" thick slabs of gel, is placed in the Texture Technologies Texture Analyzer and the probe is forced into the gel at the speed of 0.2 mm/sec to a penetration distance of 4.0 mm. The hardness of the gel is the force in grams, as recorded by a computer, required to force the probe at that speed to penetrate or deform the surface of the gel specified for 4.0 mm. Higher numbers signify harder gels. The data from the Texture Analyzer TA-XT2 may be analyzed on an IBM PC or like computer, running Microsystems Ltd, XT.RA Dimension Version 2.3 software.

The tack and stress relaxation are read from the stress curve generated when the XT.RA Dimension version 2.3 software automatically traces the force versus time curve experienced by the load cell when the penetration speed is 2.0 mm/second and the probe is forced into the gel a penetration distance of about 4.0 mm. The probe is held at 4.0 mm penetration for 1 minute and withdrawn at a speed of 2.00 mm/second. The stress relaxation is the ratio of the initial force ($F_i$) resisting the probe at the pre-set penetration depth minus the force resisting the probe ($F_f$) after 1 min divided by the initial force $F_i$, expressed as a percentage. That is, percent stress relaxation is equal to $$\frac{(F_i - F_f)}{F_i} \times 100\% \quad [077]$$

where $F_i$ and $F_f$ are in grams. In other words, the stress relaxation is the ratio of the initial force minus the force after 1 minute over the initial force. It may be considered to be a measure of the ability of the gel to relax any induced compression placed on the gel. The tack may be considered to be the amount of force in grams resistance on the probe as it is pulled out of the gel when the probe is withdrawn at a speed of 2.0 mm/second from the preset penetration depth.

An alternative way to characterize the gels is by cone penetration parameters according to ASTM D-217 as proposed in Debbaut '261; Debbaut '207; Debbaut '746; and U.S. Pat. No. 5,357,057 to Debbaut et al., each of which is incorporated herein by reference in its entirety. Cone penetration ("CP") values may range from about 70 ($10^{-1}$ mm) to about 400 ($10^{-1}$ mm). Harder gels may generally have CP values from about 70 ($10^{-1}$ mm) to about 120 ($10^{-1}$ mm). Softer gels may generally have CP values from about 200 ($10^{-1}$ mm) to about 400 ($10^{-1}$ mm), with particularly preferred range of from about 250 ($10^{-1}$ mm) to about 375 ($10^{-1}$ mm). For a particular materials system, a relationship between CP and Voland gram hardness can be developed as proposed in U.S. Pat. No. 4,852,646 to Dittmer et al.

According to some embodiments, the gel has a Voland hardness, as measured by a texture analyzer, of between about 5 and 100 grams force. The gel may have an elongation, as measured by ASTM D-638, of at least 55%. According to some embodiments, the elongation is of at least 100%. The gel may have a stress relaxation of less than 80%. The gel may have a tack greater than about 1 gram. Suitable gel materials include POWERGEL sealant gel available from Tyco Electronics Energy Division of Fuquay-Varina, NC under the RAYCHEM brand.

When the sealants 160, 230 are gels, the cable 5 and the tube 144A apply a compressive force to the sealants 160, 230 as the cable 5 is inserted into the busbar assembly 100. The gel is thereby elongated and is generally deformed and substantially conforms to the outer surface of the cable 5 and to the inner surface of the tube 144A. Some shearing of the gel may occur as well. The elongated gel may extend into and through the conductor bore 112. Moreover, the elongated gel may extend beyond the conductor member 110 into an expansion chamber 135 created by the ribs 133. Preferably, at least some of the gel deformation is elastic. The restoring force in the gel resulting from this elastic deformation causes the gel to operate as a spring exerting an outward force between the tube 144A and the cable 5. According to some embodiments, the busbar assembly 100 is adapted such that, when the cable 5 is installed in a port 144 that has not been used or has been recharged with gel using the plug assembly 200, the gel 160 and/or 230 has an elongation at the interface between the gel 160, 230 and the inner surface of the tube 144A of at least 20%.

Various properties of the gel, as described above, may ensure that the gel sealant 160, 230 maintains a reliable and long lasting hermetic seal between the tube 144A and the cable 5. The elastic memory of and the retained or restoring force in the elongated, elastically deformed gel generally cause the gel to bear against the mating surfaces of the cable 5 and the interior surface of the tube 144A. Also, the tack of the gel may provide adhesion between the gel and these surfaces. The gel, even though it is cold-applied, is generally able to flow about the cable 5 and the busbar assembly 100 to accommodate their irregular geometries.

Preferably, the sealants 160, 230 are self-healing or self-amalgamating gels. This characteristic, combined with the aforementioned compressive force between the cable 5 and the tube 144A, may allow the sealants 160, 230 to re-form into a continuous body if the gel is sheared by the insertion of the cable 5 into the connector 100. The gel may also re-form if the cable 5 is withdrawn from the gel.

The sealants 160, 230, particularly when formed of a gel as described herein, may provide a reliable moisture barrier for the cable 5 and the conductor member 110, even when the connection 101 is submerged or subjected to extreme temperatures and temperature changes. Preferably, the cover members 130, 140 and the plug member 210 are made from an abrasion-resistant material that resists being punctured by the abrasive forces.

The gel may also serve to reduce or prevent fire. The gel is typically a more efficient thermal conductor than air and, thereby, may conduct more heat from the connection. In this manner, the gel may reduce the tendency for overheating of the connection 101 that might otherwise tend to deteriorate the cable insulation and cause thermal runaway and ensuing electrical arcing at the connection 101. Moreover, the gel may be flame retardant.

While, in accordance with some embodiments, the sealants 160, 230 are gels as described above, other types of sealants may be employed. For example, the sealant 160 and/or the sealant 230 may be silicone grease or a hydrocarbon-based grease.

Various modifications may be made to the foregoing busbar assembly system 10 in accordance with the present invention. For example, the body sealant portion 164 may be omitted. According to some embodiments, the closure walls 151 and/or the closure walls 191 may be omitted. More than two closure walls may be employed in a given port 144.

The closure walls 151, 191 may be otherwise constructed so as to be penetrable and displaceable. For example, the closure walls 151, 191 may be constructed so as to be fully or partly frangible, to lack a preformed hole, and/or with or without a taper. As a further alternative, each closure wall may be constructed as a resilient, elastic membrane or panel having a preformed hole therein, the closure wall being adapted to stretch about the hole to accommodate the penetrating cable without rupturing. In such case, the hole is preferably smaller in diameter than the outer diameter of the intended cable. Closure walls of different designs and constructions may be used in the same connector as well as in the same port.

While three cable ports and conductor bores and three access ports, screw bores and set screws are shown in the busbar assembly 100, busbar assemblies according to the present invention may include more or fewer cable ports and/or access ports and corresponding or associated components as needed to allow for the connection of more or fewer cables.

Figure 11:
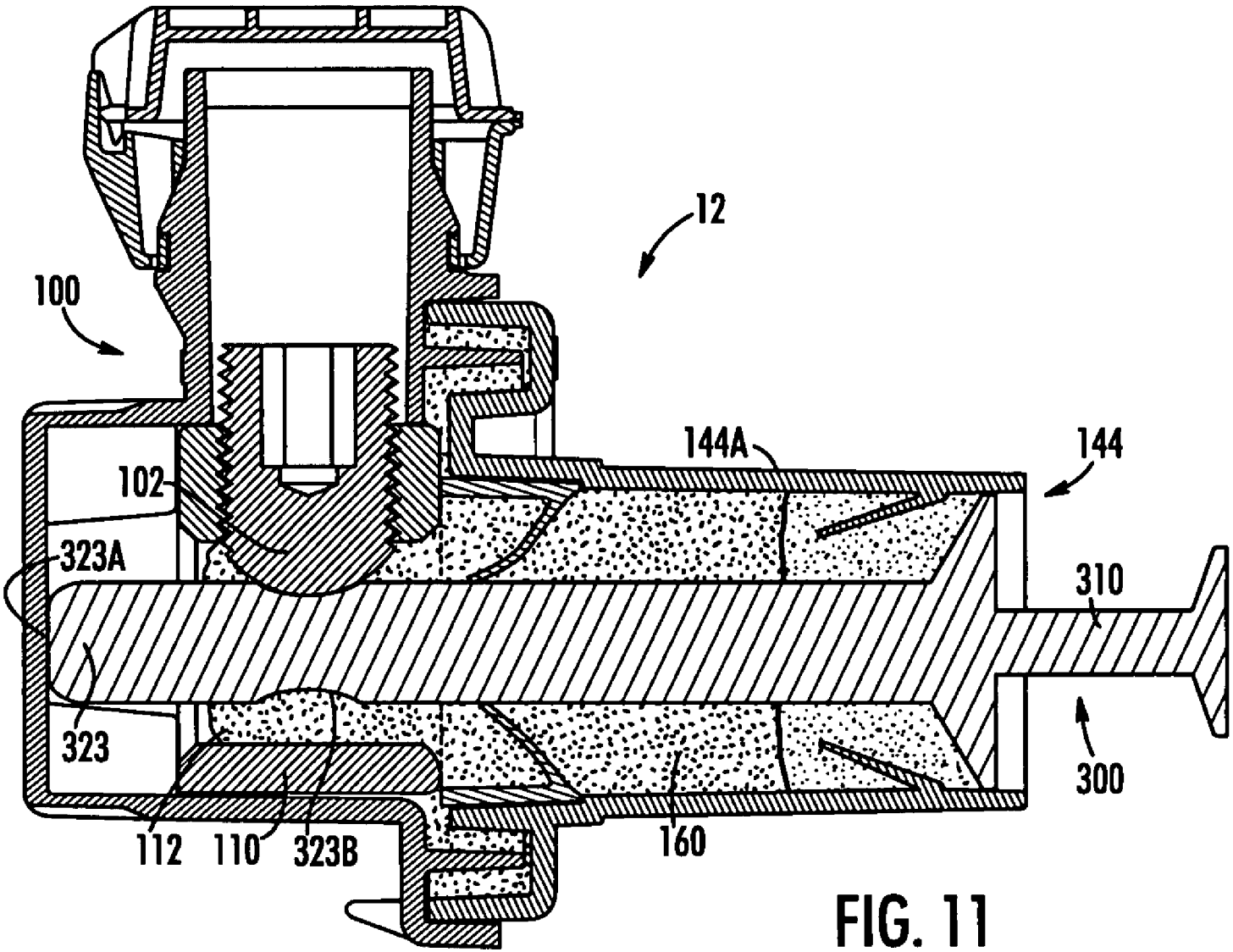
FIG. 11 is a cross-sectional view of a busbar assembly system according to further embodiments of the present invention.
Figure 12:
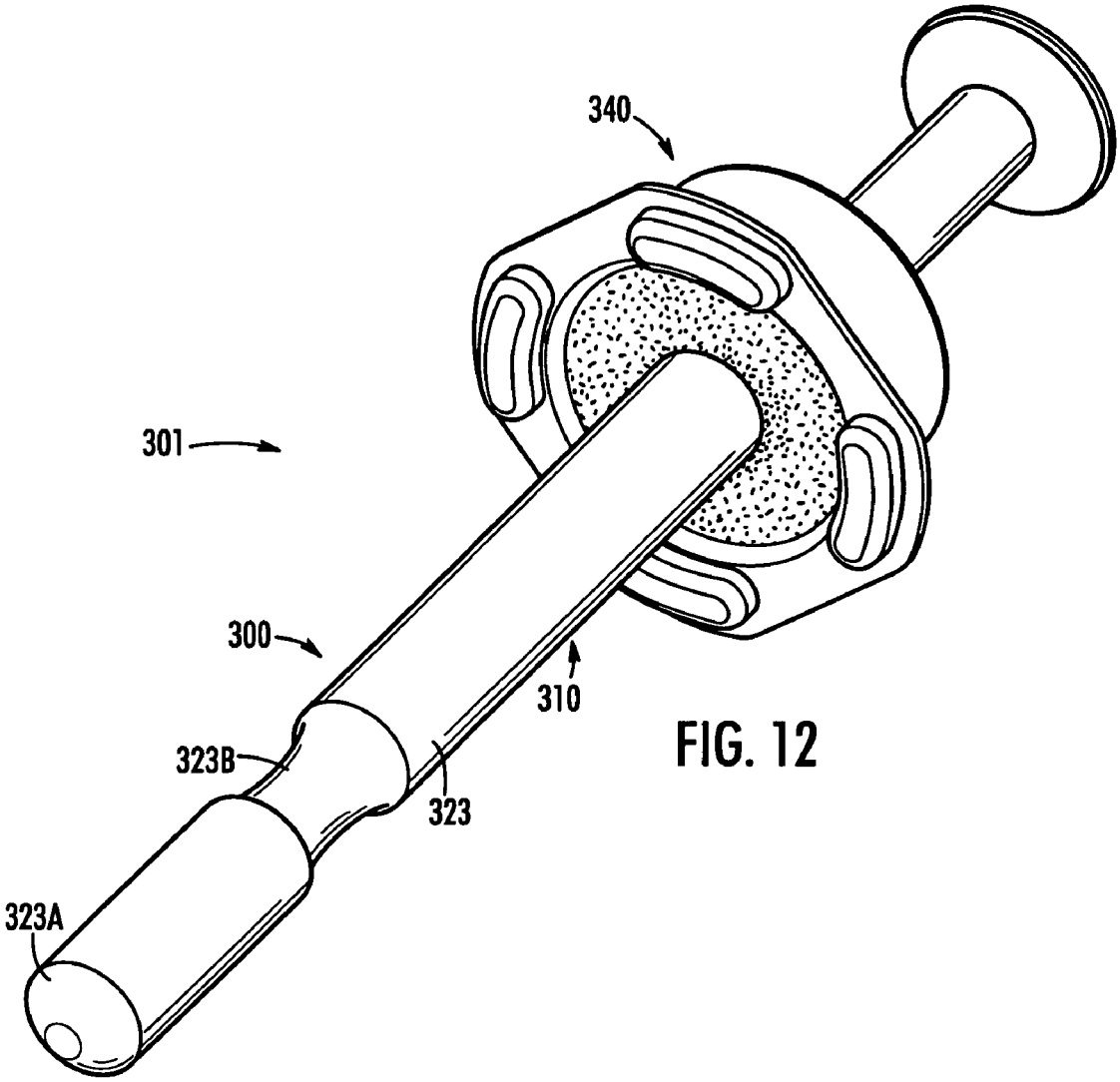
FIG. 12 is an enlarged, rear perspective view of a plug assembly system forming a part of the busbar assembly system of FIG. 11 in accordance with embodiments of the present invention.

With reference to FIGS. 11 and 12, a busbar assembly system 12 according to further embodiments of the invention is shown therein. The system 12 includes the busbar assembly 100 and a plug system 301. The plug system 301 includes a plug assembly 300 and a cover member 340. The plug system 301 may be formed in the same manner as the plug system 201 and the busbar assembly system 12 may be used in the same manner as the system 10, except as follows.

The head 320 of the plug member 310 of the plug assembly 300 has an integral, rod-shaped extended portion 323. In use, the plug assembly 300 is inserted into the tube 144A of the busbar assembly 100 as discussed with regard to the plug assembly 200, except that a distal end portion 323A of the extended portion 323 is inserted into the bore 112 of the conductor member 110. The set screw 102 is then driven down to engage and mechanically secure or capture the distal end portion 323A. The extended portion 323 may include a recess 323B to receive the screw 102 as shown. In this manner, the plug assembly 300 is secured in place in the tube 144A to sealingly plug the port 144. The user can thereafter back off the set screw 102 and remove the plug assembly 300, if desired. As discussed above, a portion of the plug sealant 330 may remain in the port 144.

While the present invention has been described herein with reference to busbar assemblies, various of the features and inventions discussed herein may be provided in other types of connectors. For example, the plug assemblies 200, 300 may be used to plug and/or recharge connectors for securing a single cable or the like.

Connectors according to the present invention may be adapted for various ranges of voltage. It is particularly contemplated that multi-tap connectors of the present invention employing aspects as described above may be adapted to effectively handle voltages in the range of 120 to 1000 volts.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed is:

1. An electrical connector system for use with a conductor, the electrical connector system comprising:

a) an electrical connector including a housing defining a conductor passage adapted to receive the conductor therethrough; and b) a plug assembly including:

a plug member; and a plug sealant mounted on the plug member;

c) wherein the plug assembly is adapted to be inserted into the conductor passage to plug the conductor passage; and d) wherein the plug assembly is adapted to deposit a portion of the plug sealant in the conductor passage when the plug assembly is inserted into the conductor passage and thereafter withdrawn from the conductor passage.

2. The electrical connector system of claim 1 wherein the plug sealant is a gel.

3. The electrical connector system of claim 1 including a connector sealant disposed in the conductor passage.

4. The electrical connector system of claim 3 wherein the plug sealant and the connector sealant are each gels.

5. The electrical connector system of claim 1 including a securing mechanism to inhibit displacement of the plug assembly from the conductor passage.

6. The electrical connector system of claim 5 wherein the securing mechanism includes an interlock structure forming a part of the plug member, the interlock structure being adapted to interlock with the connector to inhibit displacement of the plug assembly from the conductor passage.

7. The electrical connector system of claim 6 wherein:

the connector includes a penetrable closure wall extending across the conductor passage; and the interlock structure is adapted to interlock with the penetrable closure wall to inhibit displacement of the plug assembly from the conductor passage.

8. The electrical connector system of claim 5 wherein:

the connector includes an electrically conductive conductor member positioned in the housing and a holding mechanism adapted to secure the conductor to the conductor member; and the securing mechanism includes an extension portion forming a part of the plug member, the extension portion being adapted to be engaged the holding mechanism to secure the plug member to the conductor member and thereby inhibit displacement of the plug assembly from the conductor passage.

9. The electrical connector system of claim 1 wherein the plug member includes a radially outwardly extending flange adapted to apply a load to the plug sealant as the plug assembly is inserted into the conductor passage.

10. The electrical connector system of claim 9 wherein the plug member further includes a head adjacent the flange and the plug sealant is mounted on the head.

11. The electrical connector system of claim 9 wherein the plug member further includes a handle and the handle is accessible when the plug assembly is inserted into the conductor passage to facilitate removal of the plug assembly from the conductor passage.

12. The electrical connector system of claim 1 further including a cover member mounted on the plug assembly and defining a cavity, wherein the plug sealant is disposed in the cavity prior to inserting the plug assembly into the conductor passage of the connector.

13. The electrical connector system of claim 1 wherein the housing defines an interior cavity and a second conductor passage adapted to receive a second conductor, each of the first and second conductor passages communicates with the interior cavity, and the connector further includes:

an electrically conductive busbar conductor member disposed in the interior cavity; and at least one holding mechanism to selectively secure each of the conductors to the busbar conductor member for electrical contact therewith.

14. The electrical connector system of claim 13 including a connector sealant disposed in each of the first and second conductor passages.

15. The electrical connector system of claim 14 wherein:

the plug member further includes:

a radially outwardly extending flange adapted to apply a load to the plug sealant as the plug assembly is inserted into the conductor passage;

a head adjacent the flange, wherein the plug sealant is mounted on the head; and a handle, wherein the handle is accessible when the plug assembly is inserted in the conductor passage to facilitate removal of the plug assembly from the conductor passage;

the electrical connector system further includes a securing mechanism to inhibit displacement of the plug assembly from the conductor passage; and the plug sealant and the connector sealant are each gels.

16. A plug system for use with an electrical connector including a housing defining a conductor passage adapted to receive a conductor therethrough, the plug system comprising a plug assembly, the plug assembly including:

a plug member; and a plug sealant mounted on the plug member;

wherein the plug assembly is adapted to be inserted into the conductor passage to plug the conductor passage; and wherein the plug assembly is adapted to deposit a portion of the plug sealant in the conductor passage when the plug assembly is inserted into the conductor passage and thereafter withdrawn from the conductor passage.

17. The plug system of claim 16 wherein the plug sealant is a gel.

18. The plug system of claim 16 wherein the plug member includes an interlock structure adapted to interlock with the connector to inhibit displacement of the plug assembly from the conductor passage.

19. The plug system of claim 16 wherein the plug member includes a radially outwardly extending flange adapted to apply a load to the plug sealant as the plug assembly is inserted into the conductor passage.

20. The plug system of claim 19 wherein the plug member further includes a head adjacent the flange and the plug sealant is mounted on the head.

21. The plug system of claim 19 wherein the plug member further includes a handle and the handle is accessible when the plug assembly is inserted into the conductor passage to facilitate removal of the plug assembly from the conductor passage.

22. The plug system of claim 16 further including a cover member mounted on the plug assembly and defining a cavity, wherein the plug sealant is disposed in the cavity prior to inserting the plug assembly into the conductor passage of the connector.

23. A method for using a connector system including an electrical connector and a plug assembly, the connector including a housing defining a conductor passage adapted to receive a conductor therethrough, the plug assembly including a plug member and a plug sealant mounted on the plug member, the method comprising:

inserting the plug assembly into the conductor passage to plug the conductor passage; and after inserting the plug assembly into the conductor passage, withdrawing the plug assembly from the conductor passage such that a portion of the plug sealant remains in the conductor passage.

24. The method of claim 23 further including, prior to inserting the plug assembly into the conductor passage:

inserting the conductor into the conductor passage to displace a connector sealant disposed in the conductor passage; and thereafter withdrawing the conductor from the conductor passage.

25. The method of claim 23 wherein the plug sealant is a gel.

26. The method of claim 23 including securing the plug assembly in the conductor passage to inhibit displacement of the plug assembly therefrom.

27. The method of claim 26 wherein securing the plug assembly in the conductor passage includes interlocking an interlock structure of the plug member with a penetrable closure wall of the connector extending across the conductor passage.

28. The method of claim 26 wherein securing the plug assembly in the conductor passage includes engaging an extension portion of the plug member with a holding mechanism adapted to secure the conductor to an electrically conductive conductor member forming a part of the connector.

29. The method of claim 23 further including inserting a conductor through a second conductor passage of the housing such that the conductor is disposed in the second conductor passage while the plug assembly is disposed in the first conductor passage.

30. The method of claim 23 wherein inserting the plug assembly into the conductor passage includes displacing the plug sealant into the conductor passage from a cavity of a cover member mounted on the plug assembly.

31. An electrical connector system for use with a conductor, the electrical connector system comprising:

a) an electrical connector including a housing defining a conductor passage adapted to receive the conductor therethrough, a connector sealant being disposed within the conductor passage; and b) a plug assembly including:

a plug member; and a plug sealant mounted on the plug member;

c) wherein the plug assembly is adapted to be inserted into the conductor passage to plug the conductor passage; and d) wherein the plug sealant and the connector sealant are each gels.

32. An electrical connector system for use with a conductor, the electrical connector system comprising:

a) an electrical connector including a housing defining a conductor passage adapted to receive the conductor therethrough, the connector including an electrically conductive conductor member positioned in the housing and a holding mechanism adapted to secure the conductor to the conductor member;

b) a plug assembly including:

a plug member; and a plug sealant mounted on the plug member;

wherein the plug assembly is adapted to be inserted into the conductor passage to plug the conductor passage; and c) a securing mechanism to inhibit displacement of the plug assembly from the conductor passage, wherein the securing mechanism includes an extension portion forming a part of the plug member, the extension portion being adapted to be engaged with the holding mechanism to secure the plug member to the conductor member and thereby inhibit displacement of the plug assembly from the conductor passage.

33. An electrical connector system for use with a conductor, the electrical connector system comprising:

a) an electrical connector including a housing defining a conductor passage adapted to receive the conductor therethrough; and b) a plug assembly including:

a plug member; and a plug sealant mounted on the plug member;

c) wherein the plug assembly is adapted to be inserted into the conductor passage to plug the conductor passage; and d) wherein the plug member includes a radially outwardly extending flange adapted to apply a load to the plug sealant as the plug assembly is inserted into the conductor passage.

34. An electrical connector system for use with a conductor, the electrical connector system comprising:

a) an electrical connector including:

a housing defining an interior cavity and first and second conductor passages adapted to receive first and second conductors, respectively, therethrough, each of the first and second conductor passages communicating with the interior cavity;

an electrically conductive busbar conductor member disposed in the interior cavity; and at least one holding mechanism to selectively secure each of the conductors to the busbar conductor member for electrical contact therewith; and b) a connector sealant disposed in each of the first and second conductor passages, wherein the connector sealant is a gel;

c) a plug assembly adapted to be inserted into the conductor passage to plug the conductor passage and including:

a plug member;

a plug sealant mounted on the plug member, wherein the plug sealant is a gel;

a radially outwardly extending flange adapted to apply a load to the plug sealant as the plug assembly is inserted into the conductor passage;

a head adjacent the flange, wherein the plug sealant is mounted on the head; and a handle, wherein the handle is accessible when the plug assembly is inserted in the conductor passage to facilitate removal of the plug assembly from the conductor passage; and d) a securing mechanism to inhibit displacement of the plug assembly from the conductor passage.

35. A plug system for use with an electrical connector including a housing defining a conductor passage adapted to receive a conductor therethrough, the plug system comprising a plug assembly, the plug assembly including:

a plug member;

a plug sealant mounted on the plug member;

wherein the plug assembly is adapted to be inserted into the conductor passage to plug the conductor passage; and wherein the plug member includes a radially outwardly extending flange adapted to apply a load to the plug sealant as the plug assembly is inserted into the conductor passage.

36. A method for using a connector system including an electrical connector and a plug assembly, the connector including a housing defining a conductor passage adapted to receive a conductor therethrough, the plug assembly including a plug member and a plug sealant mounted on the plug member, the method comprising:

inserting the conductor into the conductor passage to displace a connector sealant disposed in the conductor passage; thereafter withdrawing the conductor from the conductor passage; and thereafter inserting the plug assembly into the conductor passage to plug the conductor passage.

37. A method for using a connector system including an electrical connector and a plug assembly, the connector including a housing defining a conductor passage adapted to receive a conductor therethrough, the plug assembly including a plug member and a plug sealant mounted on the plug member, the method comprising:

inserting the plug assembly into the conductor passage to plug the conductor passage; and securing the plug assembly in the conductor passage to inhibit displacement of the plug assembly therefrom, wherein securing the plug assembly in the conductor passage includes interlocking an interlock structure of the plug member with a penetrable closure wall of the connector extending across the conductor passage.

38. A method for using a connector system including an electrical connector and a plug assembly, the connector including a housing defining a conductor passage adapted to receive a conductor therethrough, the plug assembly including a plug member and a plug sealant mounted on the plug member, the method comprising:

inserting the plug assembly into the conductor passage to plug the conductor passage; and securing the plug assembly in the conductor passage to inhibit displacement of the plug assembly therefrom, wherein securing the plug assembly in the conductor passage includes engaging an extension portion of the plug member with a holding mechanism adapted to secure the conductor to an electrically conductive conductor member forming a part of the connector.

* * * * *